US009418666B2

(12) United States Patent
Son et al.

(10) Patent No.: US 9,418,666 B2
(45) **Date of Patent: *Aug. 16, 2016**

(54) METHOD AND APPARATUS FOR ENCODING AND DECODING AUDIO/SPEECH SIGNAL

(71) Applicant: SAMSUNG Electronics Co., Ltd., Suwon-si, Gyeonggi-do (KR)

(72) Inventors: Chang-yong Son, Gunpo-si (KR); Eun-mi Oh, Seongnam-si (KR); Jung-hoe Kim, Seoul (KR); Ho-sang Sung, Yongin-si (KR); Kang-eun Lee, Gangneung-si (KR); Ki-hyun Choo, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 206 days.

This patent is subject to a terminal disclaimer.

(21) Appl. No.: 14/132,224

(22) Filed: Dec. 18, 2013

(65) Prior Publication Data

US 2014/0108008 A1 Apr. 17, 2014

Related U.S. Application Data

(63) Continuation of application No. 11/872,116, filed on Oct. 15, 2007, now Pat. No. 8,630,863.

(30) Foreign Application Priority Data

Apr. 24, 2007 (KR) ..... 10-2007-0040042
Apr. 24, 2007 (KR) ..... 10-2007-0040043

(51) Int. Cl.
*G10L 19/00* (2013.01)
*G10L 19/025* (2013.01)

(52) U.S. Cl.
CPC ..... *G10L 19/00* (2013.01); *G10L 19/025* (2013.01)

(58) Field of Classification Search
CPC ..... G10L 19/025
See application file for complete search history.

(56) References Cited

U.S. PATENT DOCUMENTS

2005/0143979 A1 6/2005 Lee et al.
2014/0108008 A1 4/2014 Son et al.

FOREIGN PATENT DOCUMENTS

JP 2006-126372 5/2006
KR 100647336 11/2006

(Continued)

OTHER PUBLICATIONS

Korean Notice of Allowance dated Feb. 18, 2014 issued in KR Application No. 10-2007-0040042.

(Continued)

*Primary Examiner* — Brian Albertalli
(74) *Attorney, Agent, or Firm* — Sughrue Mion, PLLC

(57) ABSTRACT

Provided is a method of encoding an audio/speech signal, the method including determining a variable length of a frame, that is, a processing unit of an input signal in accordance with a position of an attack in the input signal; transforming each frame of the input signal to a frequency domain and dividing the frame into a plurality of sub frequency bands; and, if a signal of a sub frequency band is determined to be encoded in the frequency domain, encoding the signal of the sub frequency band in the frequency domain, and if the signal of the sub frequency band is determined to be encoded in a time domain, inverse transforming the signal of the sub frequency band to the time domain and encoding the inverse transformed signal in the time domain. According to the present invention, the audio/speech signal may be efficiently encoded by controlling time resolution and frequency resolution.

4 Claims, 9 Drawing Sheets

(56) References Cited

FOREIGN PATENT DOCUMENTS

| | | |
|---|---|---|
| KR | 2013-0133712 | 12/2013 |
| WO | 02/056297 | 7/2002 |

OTHER PUBLICATIONS

Korean Notice of Allowance dated Jun. 11, 2014 issued in KR Application No. 10-2013-0118803.

Korean Office Action dated Jul. 4, 2013 issued in KR Application No. 10-2007-0040042.

| PULSE | SIGN | POSITIONS |
|---|---|---|
| i0 | s0: ±1 | m0:0,5,10,15,20,25,30,35 |
| i1 | s1: ±1 | m1:1,6,11,16,21,26,31,36 |
| i2 | s2: ±1 | m2:2,7,12,17,22,27,32,37 |
| i3 | s3: ±1 | m3:3,8,13,18,23,28,33,38<br>4,9,14,19,24,29,34,39 |

| PULSE | SIGN | POSITIONS |
|---|---|---|
| i0,i1,i2,i3 | S0,S1,S2,S3: ±1 | M0:22,23,24,25 |
| i4 | S4: ±1 | M1:26,27,28,29,30,31,32,33<br>34,35,36,37,38,39,21,22 |

METHOD AND APPARATUS FOR ENCODING AND DECODING AUDIO/SPEECH SIGNAL

CROSS-REFERENCE TO RELATED APPLICATIONS

This application is a Continuation application of prior application Ser. No. 11/872,116, filed on Oct. 15, 2007 in the United States Patent and Trademark Office, which claims the benefit of Korean Patent Applications No. 10-2007-0040042 and No. 10-2007-0040043, both filed on Apr. 24, 2007, in the Korean Intellectual Property Office, the disclosure of which is incorporated herein in its entirety by reference.

BACKGROUND

1. Field

One or more embodiments of the present invention relate to a method and apparatus for encoding and decoding an audio signal and a speech signal.

2. Description of the Related Art

Conventional codecs are divided into speech codecs and audio codecs. A speech codec encodes or decodes a signal in a frequency band of 50 hertz (Hz)~7 kilo-hertz (kHz) by using a voice generation model. In general, the speech codec performs encoding and decoding by extracting parameters that represent a speech signal by modeling vocal cords and a vocal tube. An audio codec encodes or decodes a signal in a frequency band of 0 Hz~24 kHz by applying a psychoacoustic model, as in high efficiency-advanced audio coding (HE-AAC). In general, the audio codec performs encoding and decoding by omitting a signal having low sensibility to human auditory senses.

The speech codec is appropriate for encoding or decoding a speech signal, however, sound quality may be reduced when the speech codec encodes or decodes an audio signal. On the other hand, compression efficiency is excellent when the audio codec encodes or decodes the audio signal, however, the compression efficiency may be reduced when the audio codec encodes or decodes the speech signal. Accordingly, a method and apparatus for encoding or decoding a speech signal, an audio signal, or a combined signal with speech and audio signals, which may improve compression efficiency and sound quality, are required.

SUMMARY OF THE INVENTION

One or more embodiments of the present invention provides a method and apparatus for encoding an audio/speech signal, which may improve compression efficiency and sound quality by reflecting characteristics of an input signal.

One or more embodiments of the present invention also provides a method and apparatus for decoding an audio/speech signal, which may improve compression efficiency and sound quality by reflecting characteristics of an input signal.

One or more embodiments of the present invention also provides a method and apparatus for encoding an audio/speech signal in the time domain, which may improve compression efficiency and sound quality by reflecting characteristics of an input signal.

Additional aspects and utilities of the present general inventive concept will be set forth in part in the description which follows and, in part, will be obvious from the description, or may be learned by practice of the general inventive concept.

According to an aspect of the present invention there is provided a method of encoding an audio/speech signal, the method including variably determining a length of a frame, that is, a processing unit of an input signal in accordance with a position of an attack on the input signal; transforming each frame of the input signal to a frequency domain and dividing the frame into a plurality of sub frequency bands; and, if a signal of a sub frequency band is determined to be encoded in the frequency domain, encoding the signal of the sub frequency band in the frequency domain, and if the signal of the sub frequency band is determined to be encoded in a time domain, inverse transforming the signal of the sub frequency band to the time domain and encoding the inverse transformed signal in the time domain.

According to another aspect of the present invention there is provided a method of decoding an audio/speech signal, the method including checking encoding domains of an encoded signal by frames and sub frequency bands; decoding a signal checked as having been encoded in a time domain in the time domain and decoding a signal checked as having been encoded in a frequency domain in the frequency domain; and combining the decoded signal of the time domain and the decoded signal of the frequency domain and inverse transforming the combined signal to the time domain.

According to another aspect of the present invention there is provided a computer readable recording medium having recorded thereon a computer program for executing a method of decoding an audio/speech signal, the method including checking encoding domains of an encoded signal by frames and sub frequency bands; decoding a signal checked as having been encoded in a time domain in the time domain and decoding a signal checked as having been encoded in a frequency domain in the frequency domain; and combining the decoded signal of the time domain and the decoded signal of the frequency domain and inverse transforming the combined signal to the time domain.

According to another aspect of the present invention there is provided an apparatus for decoding an audio/speech signal, the apparatus including a checking unit which checks encoding domains of an encoded signal by frames and sub frequency bands; a decoding unit which decodes a signal checked as having been encoded in a time domain in the time domain and decodes a signal checked as having been encoded in a frequency domain in the frequency domain; and an inverse transformation unit which combines the decoded signal of the time domain and the decoded signal of the frequency domain and inverse transforms the combined signal to the time domain.

According to another aspect of the present invention there is provided a method of decoding an audio/speech signal, the method including checking encoding domains of an encoded signal by frames and sub frequency bands; decoding a signal checked as having been encoded in a time domain in the time domain by using an adaptive codebook and a fixed codebook based on information related to an attack in the signal; decoding a signal checked as having been encoded in a frequency domain in the frequency domain; and combining the decoded signal of the time domain and the decoded signal of the frequency domain and inverse transforming the combined signal to the time domain.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE PREFERRED EMBODIMENTS

Figure 1:
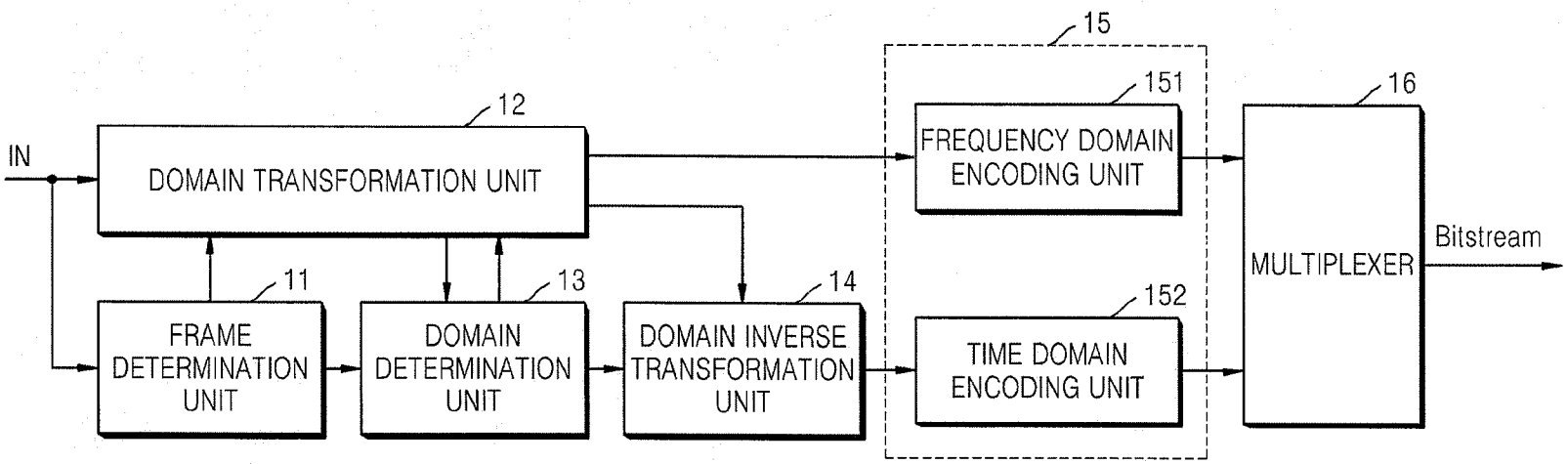
FIG. 1 is a block diagram of an apparatus for encoding an audio/speech signal, according to an embodiment of the present invention.

Since a structural or functional description is provided to describe exemplary embodiments of the present invention, the invention may be embodied in many different forms and should not be construed as being limited to the embodiments set forth herein.

One or more embodiments of the present invention will now be described more fully with reference to the accompanying drawings, in which exemplary embodiments of the invention are shown. The exemplary embodiments should be considered in descriptive sense only and not for purposes of limitation, and all differences within the scope will be construed as being included in the present invention. Like reference numerals in the drawings denote like elements.

Unless defined differently, all terms used in the description including technical and scientific terms have the same meaning as generally understood by those of ordinary skill in the art. Terms as defined in a commonly used dictionary should be construed as having the same meaning as in an associated technical context, and unless defined apparently in the description, the terms are not ideally or excessively construed as having formal meaning.

Hereinafter, exemplary embodiments of the present invention will be described in detail with reference to the attached drawings. Like reference numerals in the drawings denote like elements, and thus repeated descriptions will be omitted.

FIG. 1 is a block diagram of an apparatus for encoding an audio/speech signal, according to an embodiment of the present invention.

Referring to FIG. 1, the apparatus includes a frame determination unit 11, a domain transformation unit 12, a domain determination unit 13, a domain inverse transformation unit 14, and an encoding unit 15. The apparatus may further include a multiplexer 16. The encoding unit 15 includes a frequency domain encoding unit 151 and a time domain encoding unit 152.

The frame determination unit 11 receives an input signal IN and determines a variable length of a frame, that is a processing unit of the input signal IN, in accordance with a position of an attack in the input signal IN. The input signal IN may be a pulse code modulation (PCM) signal obtained by modulating an analog speech or audio signal into a digital signal, which may have attack onsets unperiodically.

Here, when a sound is divided into three steps such as generation, continuation, and vanishment, the attack corresponds to the generation. For example, the onset of the attack may be the starting of a note when a musical instrument starts to be played in an orchestra. An attack time is a period from when the sound is generated until it reaches its maximum volume, while a decay time is a period from the maximum volume to a middle volume of the sound. For example, when a piano key is hit to sound 'ding', a period from when the piano key is hit until the 'ding' sound reaches its maximum volume is the attack time, and a period from when the 'ding' sound starts to fade until before it completely vanishes is the decay time.

Here, in data communication, the frame is a package of information to be transmitted as a unit and may be a unit of encoding and decoding. Specifically, the frame may be a basic unit for applying fast Fourier transformation (FFT) in order to transform time domain data into frequency domain data. In this case, each frame may generate a frequency domain spectrum.

A conventional audio encoder processes an audio signal with a fixed length of frames. For example, G.723.1 and G.729 of International Telecommunication Union-Telecommunication Standardization Sector (ITU-T) are representative encoding algorithms. The length of the frames is fixed to 30 ms in accordance with the G.723.1 algorithm and is fixed to 10 ms in accordance with the G.729 algorithm. An adaptive multi rate-narrow band (AMR-NB) encoder performs encoding of the frames having a fixed length of 20 ms. As such, when the audio signal is processed with the frames having the fixed length, the audio signal is encoded without considering the characteristics of the audio signal such as a position and intensity of an attack and thus compression efficiency may be reduced and sound quality may be lowered.

In more detail, the frame determination unit 11 divides the input signal IN into a stationary region and a transition region in accordance with the position of the attack in which a sound of the input signal IN is generated. For example, the frame determination unit 11 may determine a region where the attack exists as the transition region and a region where the attack does not exist as the stationary region. The frame determination unit 11 may determine the length of a variable frame of the transition region short in accordance with the intensity of the attack in the input signal IN, and also may determine the length of the variable frame of the stationary region long in accordance with how stationary the stationary region is, that is, in accordance with a range where the attack does not exist.

In more detail, the higher the intensity of the attack in the transition region is, the shorter the length of the variable frame may be determined to be by the frame determination unit 11. Thus, time resolution may be improved by performing encoding on the variable frame of a short region. In general, resolution is used as an index which represents preciseness of an image of a screen. The time resolution in an audio domain represents the resolution, that is, the preciseness, of the audio signal in a temporal direction.

On the other hand, the more stationary the stationary region is, that is, the greater the range where the attack does not exist is, the longer the length of the variable frame may be determined to be by the frame determination unit 11. Thus, by performing encoding on the variable frame of a long region, the time resolution is restricted, however, frequency resolution may be improved by detecting frequencies and variations of the input signal IN for a long time. The frequency resolution in the audio domain represents the resolution, that is, the preciseness, of the audio signal in a frequency direction. This can be more apparent in consideration that time is inversely proportional to frequency.

As such, by determining variable lengths of frames of the input signal IN, the time resolution is improved in a region with great sound variations such as the transition region and the frequency resolution is restricted, and the frequency resolution is improved in a region with less sound variations such as the stationary region and the time resolution is restricted. Accordingly, encoding efficiency may be improved.

Also, when the input signal IN of a time domain is transformed into a frequency domain signal, the frame determination unit 11 determines a length of a window in accordance with the position of the attack in the input signal IN. Since the input signal IN is the PCM signal of the time domain, the input signal IN has to be transformed into the frequency domain signal. Since data to be processed by using discrete cosine transformation (DCT) or the FFT is a certain finite region of a periodically repeated signal, the certain region has to be selected to transform the input signal IN of the time domain into the frequency domain signal. In this case, the window is used. As such, by applying the window to the input signal IN of the time domain, the input signal IN may be transformed to the frequency domain. Since time is reciprocal to frequency, if the width of the window is narrower, the time resolution gets better while the frequency resolution gets worse, and if the width of the window is wider, the frequency resolution gets better while the time resolution gets worse. Adjusting the width of the window is similar to adjusting of the length of the frame.

Furthermore, the frame determination unit 11 may provide attack information such as the position and intensity of the attack in the input signal IN to the encoding unit 15. Specifically, the attack information may be provided to the time domain encoding unit 152 and may be used to perform encoding in the time domain.

The domain transformation unit 12 transforms each frame of the input signal IN of the time domain to the frequency domain and divides the frame into a plurality of sub frequency bands. Specifically, the domain transformation unit 12 receives the input signal IN and variably adjusts the frames of the input signal IN based on the output of the frame determination unit 11, that is, based on the lengths of the frames determined by the frame determination unit 11. Then, the domain transformation unit 12 divides each of the frames into the sub frequency bands and provides the divided frames to the domain determination unit 13.

The input signal IN of the time domain may be transformed to the frequency domain by using a modified discrete cosine transformation (MDCT) method so as to be represented as a real part, and may be transformed to the frequency domain by using a modified discrete sine transformation (MDST) method so as to be represented as an imaginary part. Here, a signal that is transformed by the MDCT method and is represented as the real part is used to encode the input signal IN and a signal that is transformed by the MDST method and is represented as the imaginary part is used to apply a psychoacoustic model.

The domain determination unit 13 determines whether to encode the input signal IN in the frequency domain or the time domain by the sub frequency bands based on the frames, which are determined to have different lengths from each other in accordance with the characteristics of the input signal IN, such as the position of the attack. Specifically, the domain determination unit 13 may determine encoding domains of the input signal IN by the sub frequency bands based on a spectral measurement method measuring linear prediction coding gains, spectrum variations between linear prediction filters of neighboring frames, spectral tilts, or the like, an energy measurement method measuring signal energy of each frequency band, variations of signal energy between frequency bands, or the like, a long-term prediction estimation method estimating predicted pitch delays, predicted long-term prediction gains, or the like, or a voicing level determination method distinguishing a voiced sound from a non-voice sound.

The domain inverse transformation unit 14 inverse transforms a signal of a sub frequency band determined to be encoded in the time domain by the domain determination unit 13 to the time domain based on the output of the domain determination unit 13.

As such, the lengths of the frames of the input signal IN are differently determined by the frame determination unit 11 and the domain determination unit 13, each of the frames of the input signal IN is divided into the sub frequency bands, and the encoding domains are determined by the sub frequency bands. Accordingly, the input signal IN is encoded in different domains by the frames and sub frequency bands.

If a signal is determined to be encoded in the frequency domain by the domain determination unit 13, the frequency domain encoding unit 151 receives the signal from the domain transformation unit 12 and encodes the signal in the frequency domain. If a signal is determined to be encoded in the time domain by the domain determination unit 13, the time domain encoding unit 152 receives the signal from the domain inverse transformation unit 14 and encodes the signal in the time domain.

According to another embodiment of the present invention, the signals received from the domain transformation unit 12 and the domain inverse transformation unit 14 may be first input to the frequency domain encoding unit 151. In this case, a time domain signal generated by the domain inverse transformation unit 14 may be output from the frequency domain encoding unit 151 and be input to the time domain encoding unit 152. The encoding unit 15 may receive the attack information such as the position and intensity of the attack in the input signal IN from the frame determination unit 11 and may adaptively use the attack information for the encoding of the input signal IN. Also, the time domain encoding unit 152 receives information on the encoding of the frequency domain from the frequency domain encoding unit 151 and uses the information for the encoding of the time domain. For example, the time domain encoding unit 152 may obtain the intensity of the attack from an amount of recognition information from among the information on the encoding of the frequency domain. That is, a perceptual entropy (PE) value, which represents energy variation of an audio signal, may exhibit correlations between harmonics, which represent regularities of vibration of vocal cords in the frequency domain. The intensity of the attack and the harmonic correlations may be used for the encoding of the time domain. Detailed description thereof will be made later with reference with FIGS. 8A and 8B.

The multiplexer 16 receives and multiplexes the outputs of the frequency domain encoding unit 151 and the time domain encoding unit 152, that is, the encoded result of the frequency domain and the encoded result of the time domain, thereby generating a bitstream.

Figure 2:
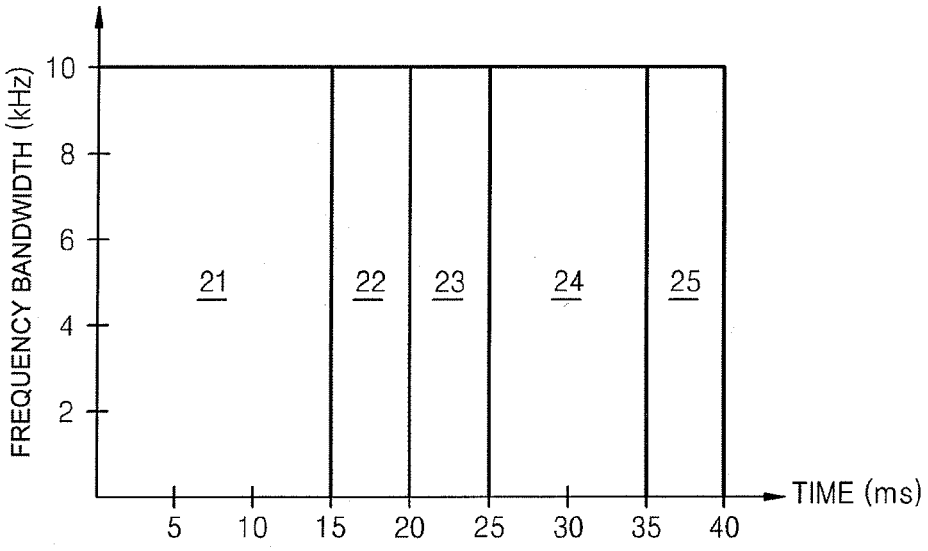
FIG. 2 is a graph illustrating adjusted frames in an apparatus for encoding an audio/speech signal, according to an embodiment of the present invention.

FIG. 2 is a graph illustrating adjusted frames in an apparatus for encoding an audio/speech signal, according to an embodiment of the present invention.

Referring to FIG. 2, lengths of first through fifth frames 21 through 25 of an input signal may be determined to be different, as described above with reference to FIG. 1. For example, the first frame 21 has a length of 15 ms, each of the second and third frames 22 and 23 has a length of 5 ms, the fourth frame 24 has a length of 10 ms, and the fifth frame 25 has a length of 5 ms. In other words, the first frame 21 has the longest length, the fourth frame 24 has the second longest length and each of the second, third, and fifth frames 22, 23, and 25 has the shortest length.

Each of the second, third, and fifth frames 22, 23, and 25 having the shortest length may be a transition region in which an attack is detected. If the attack is detected, time resolution may be improved by adjusting the length of a frame to be short and adjusting a transform window to be short. The first frame 21 having the longest length may be a stationary region in which the attack is not detected. If the attack is not detected, frequency resolution may be improved by adjusting the length of the frame to be long and adjusting the transform window to be long in accordance with how stationary the frame is, that is, in accordance with an interval of detected attacks.

Figure 3:
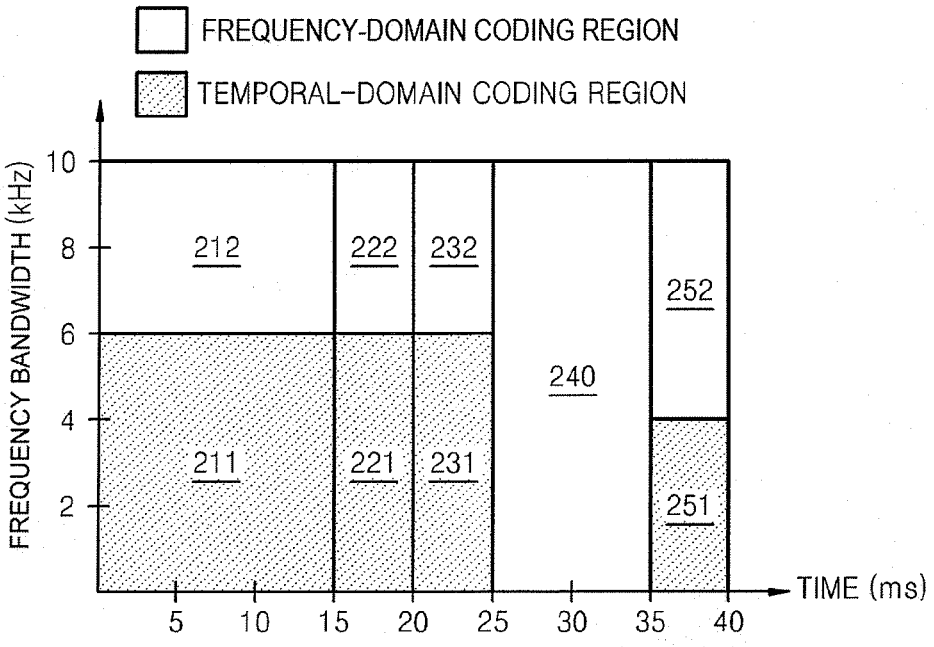
FIG. 3 is a graph illustrating encoding domains of an input signal by frames and frequency bands in an apparatus for encoding an audio/speech signal, according to an embodiment of the present invention.

FIG. 3 is a graph illustrating encoding domains of an input signal by frames and frequency bands in an apparatus for encoding an audio/speech signal, according to an embodiment of the present invention.

Referring to FIGS. 2 and 3, the encoding domains of the input signal may be different as determined by the frames and frequency bands, as described above with reference to FIG. 1. The domain determination unit 13 illustrated in FIG. 1 may adaptively determine advantageous encoding domains of the input signal by the frequency bands in accordance with the characteristics of the input signal. In FIG. 3, a blank region represents a frequency domain coding region and a dotted region represents a time domain coding region.

For example, encoding domains of the first frame 21 may be determined by the frequency bands so as to encode a frequency band 211 of 0~6 kilo hertz (kHz) in a time domain and encode a frequency band 212 of 6~10 kHz in a frequency domain. Encoding domains of the second frame 22 may be may be determined by the frequency bands so as to encode a frequency band 221 of 0~6 kHz in the time domain and encode a frequency band 222 of 6~10 kHz in the frequency domain. Encoding domains of the third frame 23 may be determined by the frequency bands so as to encode a frequency band 231 of 0~6 kHz in the time domain and encode a frequency band 232 of 6~10 kHz in the frequency domain. An encoding domain of the fourth frame 24 may be determined so as to encode a frequency band 240 of 0~10 kHz in the frequency domain. Encoding domains of the fifth frame 25 may be determined by the frequency bands so as to encode a frequency band 251 of 0~4 kHz in the time domain and encode a frequency band 252 of 4~10 kHz in the frequency domain.

According to a conventional apparatus for encoding an audio/speech signal, frames have a fixed length and encoding domains are different as determined by the frequency bands of the frames. However, in an apparatus for encoding an audio/speech signal according to an embodiment of the present invention, lengths of the frames may be variably adjusted in accordance with the characteristics of an input signal and encoding domains may be different as determined by the frequency bands of each frame. As such, time resolution and frequency resolution may be improved by adjusting the lengths of the frames and varying the sizes of windows in accordance with a position and intensity of an attack on the input signal.

Figure 4:
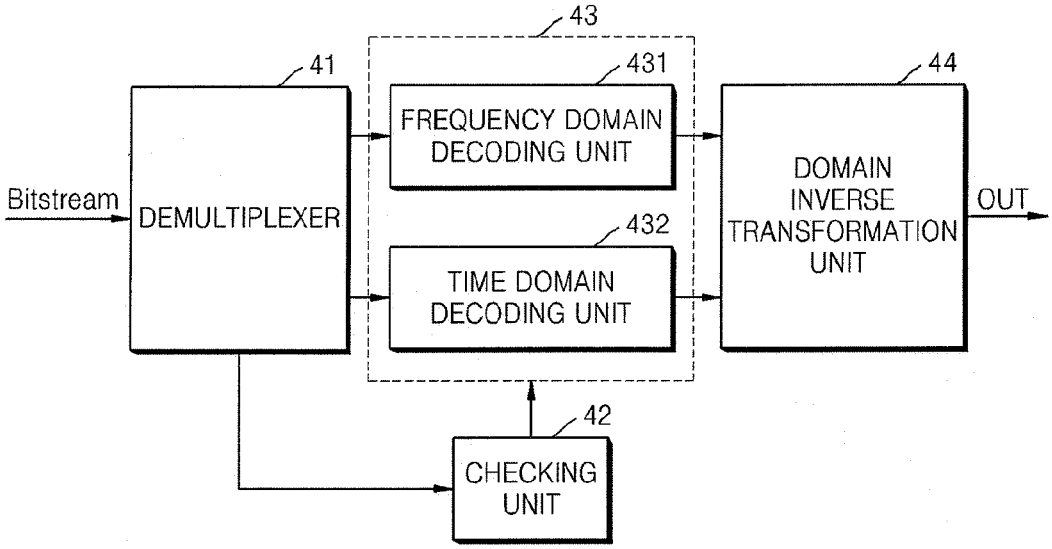
FIG. 4 is a block diagram of an apparatus for decoding an audio/speech signal, according to an embodiment of the present invention.

FIG. 4 is a block diagram of an apparatus for decoding an audio/speech signal, according to an embodiment of the present invention.

Referring to FIG. 4, the apparatus includes a demultiplexer 41, a checking unit 42, and a decoding unit 43. The apparatus may further include a domain inverse transformation unit 44. The decoding unit 43 includes a frequency domain decoding unit 431 and a time domain decoding unit 432.

The demultiplexer 41 receives and demultiplexes a bitstream so as to output an encoded result of a frequency domain and an encoded result of a time domain.

The checking unit 42 checks encoding domains of a demultiplexed signal for different lengths and frequency bands of frames based on information obtained from the demultiplexed signal, and provides the checking result to the decoding unit 43. The encoding domains of the demultiplexed signal may be different for the different lengths and frequency bands of the frames.

If the demultiplexed signal was encoded in the frequency domain in accordance with the checking result of the checking unit 42, the frequency domain decoding unit 431 decodes the demultiplexed signal in the frequency domain. If the demultiplexed signal was encoded in the time domain in accordance with the checking result of the checking unit 42, the frequency domain decoding unit 431 decodes the demultiplexed signal in the time domain.

According to another embodiment of the present invention, the demultiplexed signal may be firstly input to the frequency domain decoding unit 431. In this case, if the demultiplexed signal was encoded in the time domain in accordance with the checking result of the checking unit 42, the demultiplexed signal may be output from frequency domain decoding unit 431 and be input to the time domain decoding unit 432.

The domain inverse transformation unit 44 receives the output of the decoding unit 43, that is, receives a decoded signal and inverse transforms the decoded signal into a time domain signal by combining a signal decoded in the time domain and a signal decoded in the frequency domain.

Figure 5:
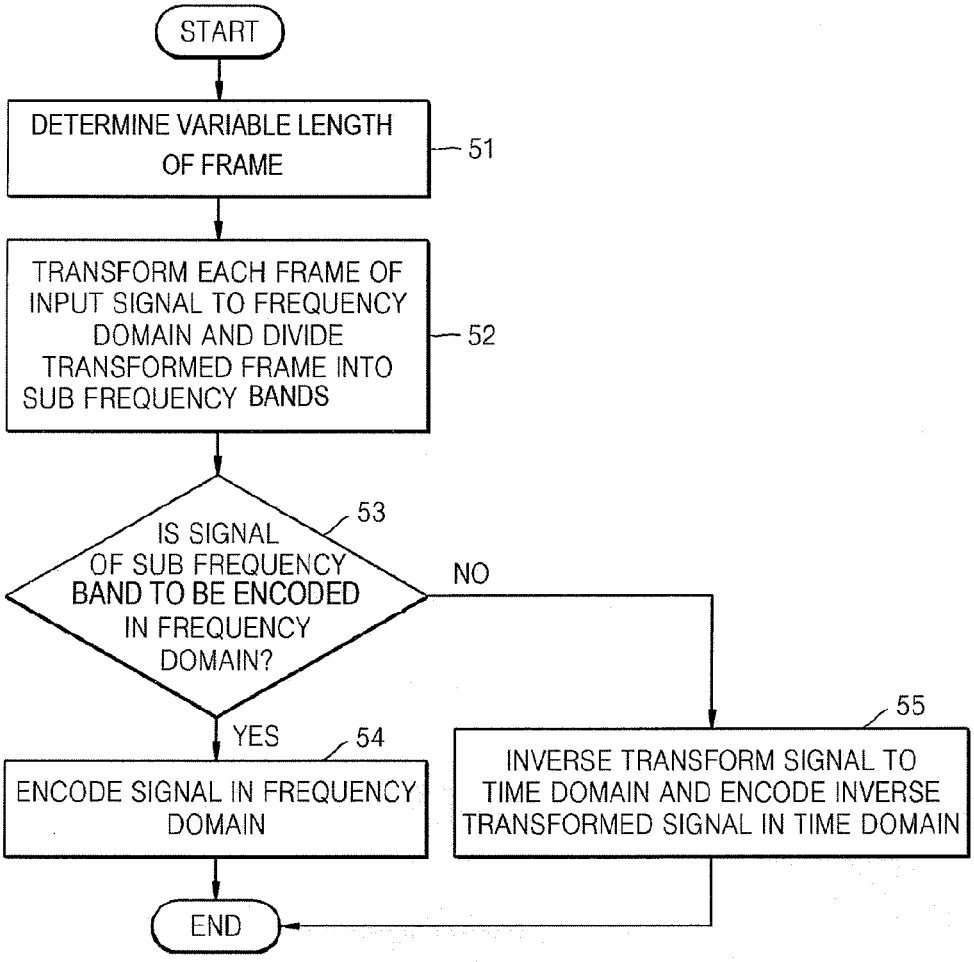
FIG. 5 is a flowchart of a method of encoding an audio/speech signal, according to an embodiment of the present invention.

FIG. 5 is a flowchart of a method of encoding an audio/speech signal, according to an embodiment of the present invention.

Referring to FIG. 5, in operation 51, a variable length of a frame, that is, a variable processing unit of an input signal, is determined in accordance with a position of an attack on the input signal. Specifically, the input signal is divided into a stationary region and a transition region in accordance with the position of the attack and the length of the frame of the stationary region, which is determined differently from the length of the frame of the transition region. For example, the length of the frame may be determined to be long in the stationary region and may be determined to be short in the transition region in accordance with the intensity of the attack.

In operation 52, each frame of the input signal is transformed to a frequency domain and the transformed frame is divided into a plurality of sub frequency bands.

In operation 53, whether to encode a signal of a sub frequency band in the frequency domain or in the time domain is determined.

In operation 54, if it is determined to encode the signal in the frequency domain, the signal is encoded in the frequency domain.

In operation 55, if it is determined to encode the signal in the time domain, the signal is inverse transformed to the time domain and is encoded in the time domain.

Figure 6:
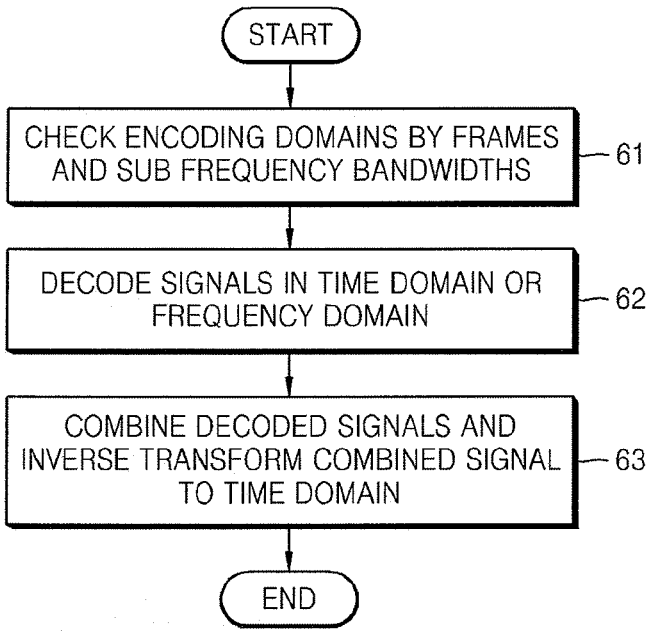
FIG. 6 is a flowchart of a method of decoding an audio/speech signal, according to an embodiment of the present invention.

FIG. 6 is a flowchart of a method of decoding an audio/speech signal, according to an embodiment of the present invention.

Referring to FIG. 6, in operation 61, encoding domains of an encoded signal are checked by frames and sub frequency bands.

In operation 62, a signal checked as having been encoded in the frequency domain is decoded in the frequency domain, and a signal checked as having been encoded in the time domain is decoded in the time domain.

In operation 63, the decoded signals are inverse transformed to the time domain after combining the signal decoded in the time domain and the signal decoded in the frequency domain.

Figure 7:
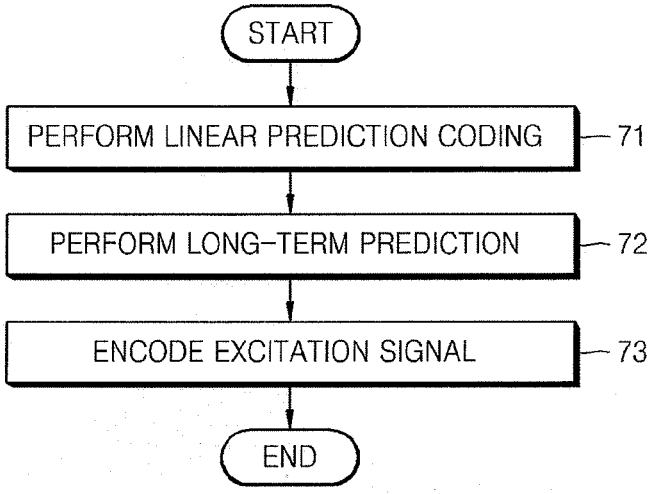
FIG. 7 is a schematic flowchart of a method of encoding data in the time domain, according to an embodiment of the present invention.

FIG. 7 is a schematic flowchart of a method of encoding in the time domain, according to an embodiment of the present invention.

Referring to FIG. 7, the method includes operation 71 of performing linear prediction coding on an input signal, operation 72 of performing long-term prediction, and operation 73 of encoding an excitation signal. Each operation will now be described in detail.

In operation 71, the linear prediction coding is performed on the input signal. Linear prediction coding is a method of approximating a speech signal at a current time by the linear combination of a previous speech signal. Since a value of the current time signal is modeled by a value of past time neighboring the current time, the linear prediction coding is also referred to as short-term prediction. Here, in general, the signal value at the past time is less than the value at the current time. As such, a coefficient of a linear prediction filter is calculated by predicting a current voice sample from past voice samples so as to minimize an error with an original sample.

A formant is a resonance frequency generated by vocal cords or a nasal meatus and is also referred to as a formant frequency. The formant varies in accordance with a geometric shape of the vocal cords and a certain speech signal may be represented as a few representative formants. The speech signal may be divided into a formant component which follows a vocal tube model and a pitch component which reflects vibration of the vocal cords. The vocal tube model may be modeled by a linear prediction encoding filter and an error component represents the pitch component except for the formant.

In operation 72, long-term prediction is performed on the signal. Long-term prediction is a method of detecting the pitch component from a linear prediction (LP) residual generated after operation 71, extracting a past signal stored in an adaptive codebook, that is, extracting the past signal by as much as a pitch delay of the detected pitch component, and encoding a signal to be currently analyzed by calculating the most appropriate period and gain of the current signal. When the adaptive codebook is applied, a method of detecting a pitch comprises approximating the speech signal of the current time by multiplying the previous speech signal by as much as the pitch delay, that is, a pitch lag by a fixed pitch gain. While the linear prediction coding is referred to as the short-term prediction, because the value of the current time is modeled by the value of the past time neighboring the current time, the method of operation 72 is referred to as long-term prediction, because the signal to be currently analyzed is encoded by calculating the most appropriate period and gain of the current signal.

In general, a pitch of the speech signal is analogous to a fundamental frequency. The fundamental frequency is the most fundamental frequency of the speech signal, that is, a frequency of large peaks on a temporal axis, and is generated by periodic vibration of the vocal cords. The pitch is a parameter to which human auditory senses are sensitive and may be used to identify a speaker who generated the speech signal. Therefore, accurate interpretation of the pitch is an essential element for sound quality of voice synthesis and accurate extraction and restoring greatly affects the sound quality. Also, pitch data may be used as a parameter to distinguish a voiced sound from a non-voiced sound of the speech sound. The pitch is periodic pulses that occur when compressed air generates the vibration of the vocal cords. Accordingly, the non-voiced sound, which generates turbulent flow without vibrating the vocal cords, does not have pitch.

In operation 73, the excitation signal, which is a residual component not encoded in operations 71 and 72, is encoded by searching a fixed codebook. The codebook is composed of representative values of the residual signal of the speech signal after extracting the formant and pitch components, is generated by performing vector quantization, and represents combinations of positions available for the pulses. Specifically, the most similar parts between the excitation signal and the fixed codebook are found as the residual components, and a codebook index and codebook gain are transmitted.

Figure 8A:
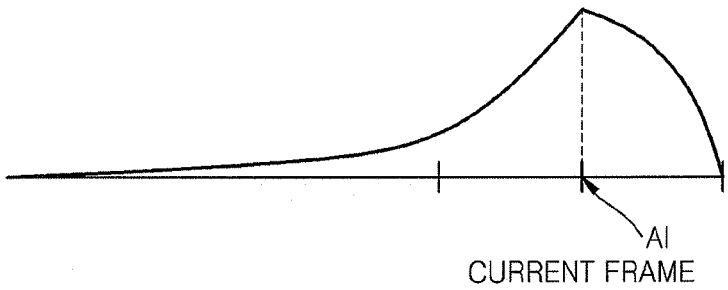
FIG. 8A shows an exemplary window used for linear prediction analysis which is performed in the method of FIG. 7.
Figure 8B:
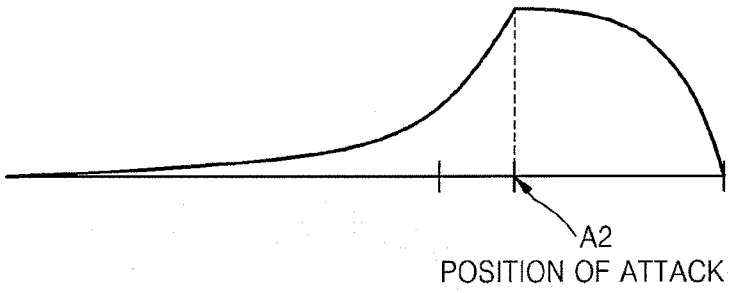
FIG. 8B shows an exemplary window used for linear prediction analysis which is adaptively performed for a position of an attack, according to an embodiment of the present invention.

FIG. 8A shows an exemplary window used for linear prediction analysis which is performed in the method of FIG. 7. FIG. 8B shows an exemplary window used for linear prediction analysis which is adaptively performed for a position of an attack, according to an embodiment of the present invention. An adaptive encoding method by the linear prediction analysis will now be descried with reference to FIGS. 7, 8A, and 8B.

The analysis window illustrated in FIG. 8A is used for the linear prediction analysis when the linear prediction coding is performed on a current frame. The window allows a part of a signal to be viewed, that is, a signal of a short temporal region for a long signal, that is, a signal of a long temporal region.

The window of the current frame has a peak at A1. In this case, although a position of an attack may not be identical to A1, the linear prediction analysis is performed by using the fixed window regardless of the position of the attack. Thus, an attack signal may be spread out and encoding efficiency may be reduced.

The analysis window illustrated in FIG. 8B is used for adaptively performing the linear prediction analysis for the position of the attack when the linear prediction coding is performed on the current frame. Specifically, the linear prediction analysis may receive information on the position of the attack from a frame determination unit and may be adaptively performed by applying the shape of the window differently in accordance with the position of the attack.

In more detail, in a region where the frame determination unit has detected the position of the attack, and which is determined as a transition region, that is, in a region where an attack exists, the analysis window used for the linear prediction analysis may be adaptively adjusted in accordance with the position of the attack. For example, if the current frame is the transition region and the attack is located at A2, the shape of the analysis window may be adjusted so as to have a peak at A2. As such, by adaptively adjusting the window for the information on the position of the attack, that is, by adaptively adjusting the location of the peak, the attack signal may be prevented from being spread.

Alternatively, the linear prediction analysis may be performed by adjusting the length of the window long in the region where the frame determination unit has detected the position of the attack and which is determined as the transition region.

Figures 9, 10A, 10B:
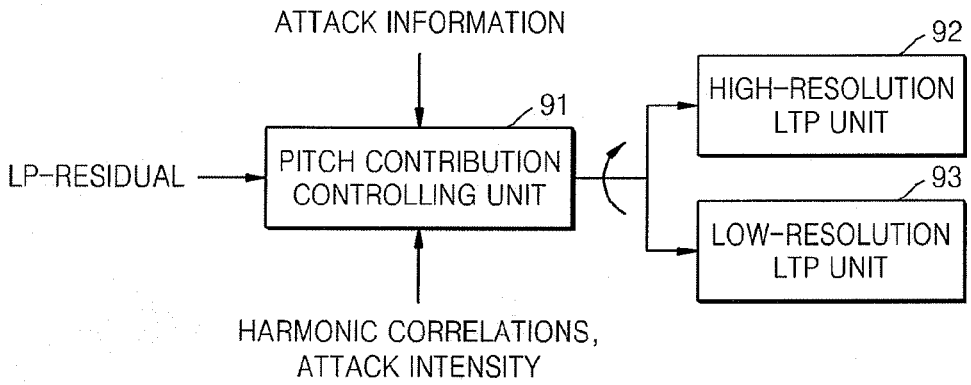
FIG. 9 is a schematic block diagram of a long-term prediction unit according to an embodiment of the present invention.
FIG. 10A shows an example of a pulse track structure of a fixed codebook used when an excitation signal is encoded in the method of FIG. 7.
FIG. 10B shows an example of a pulse track structure of a fixed codebook which is adaptively applied for a position of an attack, according to an embodiment of the present invention.

FIG. 9 is a schematic block diagram of a long-term prediction unit according to an embodiment of the present invention.

Referring to FIG. 9, the long-term prediction unit includes a pitch contribution controlling unit 91, a high-resolution long-term prediction unit 92, and a low-resolution long-term prediction unit 93.

The pitch contribution controlling unit 91 selectively transmits an LP-residual generated after linear prediction coding is performed based on information on the encoding of the frequency domain, to the high-resolution long-term prediction unit 92 or the low-resolution long-term prediction unit 93.

Specifically, the pitch contribution controlling unit 91 receives attack information such as a position of an attack from a frame determination unit. In accordance with the position of the attack, the pitch contribution controlling unit 91 may perform high-resolution long-term prediction by transmitting the LP-residual to the high-resolution long-term prediction unit 92 for a region where an attack exists, that is, a transition region, and may perform low-resolution long-term prediction by transmitting the LP-residual to the low-resolution long-term prediction unit 93 for a region where the attack does not exist, that is, a stationary region.

Here, resolution of the high or low-resolution long-term prediction represents the resolution of a pitch delay and pitch gain, which are parameters used for searching an adaptive codebook. As described above, if a pitch of a signal is indicated by a sample interval, the adaptive codebook may have an excellent performance with respect to an analysis voice which has a pitch interval of an integer. On the other hand, the performance of the adaptive codebook is greatly reduced if the pitch interval is not multiple integer times the sample interval. In this case, in order to maintain the performance of the codebook, a fractional pitch method and an integer pitch method, also referred to as a multi-tap adaptive codebook method, are used. In the fractional pitch method, it is assumed that the pitch of the signal is a fraction instead of an integer. For example, in consideration of transmission capacity, it is assumed that the pitch is a value that is any multiple of the fraction 0.25. Firstly, a current signal is oversampled in order to obtain resolution by 0.25 from the current signal. Also, a past signal is four times oversampled and a period and gain are obtained by searching the adaptive codebook. According to the above-described fraction pitch method, the performance of the adaptive codebook may be maintained even when the pitch interval is not an integer. On the other hand, an operation is required to be performed four or more times for calculation for the oversampling and impulse response filtering for comparison with the analysis voice. Furthermore, an additional bit is required to transmit a fractional pitch. For example, 2 bits are required in the fractional pitch method by 0.25.

In other words, in the high-resolution long-term prediction unit 92, preciseness may be improved by improving the resolution of the pitch delay and pitch gain, while an additional bit has to be allocated. On the other hand, in the low-resolution long-term prediction unit 93, the preciseness may be reduced by reducing the resolution of the pitch delay and pitch gain, while the number of bits to be allocated is reduced.

Also, the pitch contribution controlling unit 91 receives correlations between harmonics from a frequency domain encoding unit. As described above, the harmonics represent regularities of vibration of vocal cords. Accordingly, if the harmonics occur periodically, the correlations between the harmonics are large, and if the harmonics occur unperiodically, the correlations between the harmonics are small. Furthermore, the pitch contribution controlling unit 91 receives information on the intensity of an attack from the frequency domain encoding unit. The intensity of the attack may be obtained from recognition entropies.

The high-resolution long-term prediction unit 92 may perform the high-resolution long-term prediction on not only integer samples but also fractional samples existing between the integer samples. In this case, the number of bits to be allocated increases and the preciseness is improved.

The low-resolution long-term prediction unit 93 may perform the low-resolution long-term prediction on the integer samples. In this case, the number of bits to be allocated is reduced and the preciseness is also reduced in comparison with the high-resolution long-term prediction unit 92.

For example, when the adaptive codebook is applied, if the transition region is determined by information on the position of the attack, the information received from the frame determination unit, the high-resolution long-term prediction may be performed on the transition region. If the stationary region where the attack does not exist is determined, the low-resolution long-term prediction may be performed on the stationary region.

For example, when the adaptive codebook is applied and information on the correlations between harmonics is received from the frequency domain encoding unit, if the correlations between harmonics are large, that is, if the signal has regular pitches, the high-resolution long-term prediction may be performed and if the correlations between harmonics are small, the low-resolution long-term prediction may be performed.

For example, when the adaptive codebook is applied and information on the intensity of the attack is received from the frequency domain encoding unit, if the intensity of the attack is large, the high-resolution long-term prediction may be performed and if the intensity of the attack is small, the low-resolution long-term prediction may be performed.

FIG. 10A shows an example of a pulse track structure of a fixed codebook used when an excitation signal is encoded in the method of FIG. 7. FIG. 10B shows an example of a pulse track structure of a fixed codebook which is adaptively applied in accordance with a position of an attack, according to an embodiment of the present invention. A method of adaptively applying the fixed codebook in accordance with information on the position of the attack will now be described with reference to FIGS. 10A and 10B.

Referring to FIG. 10A, in the pulse track structure according to a G.729 algorithm, first through fourth tracks have first through fourth pulses i0, i1, i2, and i3, respectively. Each of the first through fourth pulses i0, i1, i2, and i3 has a value of +1 or −1. Pulse position indices of the first track are 0, 5, 10, 15, 20, 25, 30, and 35, the pulse position indices of the second track are 1, 6, 11, 16, 21, 26, 31, and 36, the pulse position indices of the third track are 2, 7, 12, 17, 22, 27, 32, and 37, and the pulse position indices of the fourth track are 3, 8, 13, 18, 23, 28, 33, 38, 4, 9, 14, 19, 24, 29, 34, and 39. Here, searching of a fixed codebook means searching for an optimum pulse position for each of the first through fourth tracks.

As such, thirteen bits are allocated to represent the position indices (3+3+3+4=13), and four bits are allocated to represent a sign of each pulse (1+1+1+1=4). However, when the fixed codebook having the fixed track structure as described above is used, a pulse is detected at a fixed position regardless of the occurrence of an attack and thus efficient encoding may not be performed.

Referring to FIG. 10B, the fixed codebook according to the current embodiment of the present invention is adaptively applied in accordance with a position of an attack. Because, when the attack occurs, there is a strong probability that sequential pulses exist around the attack. When the fixed pulse track structure is used as described above in FIG. 10A, the pulses are detected at the same rate in a region where the attack does not occur as in a region where the attack occurs, and thus encoding efficiency is reduced.

For example, in the pulse track structure having forty samples, a first track has first through fourth pulses i0, i1, i2, and i3, a second track has a fifth pulse i4, and each pulse of the first through fifth pulses i0, i1, i2, i3 and i4 has a value of +1 or −1. Firstly, five bits are allocated so as to represent the position of the attack at pulse position indices 0, 3, 5, 7, 8, 9, 10, 11, 12, 13, 14, 15, 16, 17, 18, 19, 20, 21, 22, 23, 24, 25, 26, 27, 28, 29, 30, 31, 32, 34, 36, and 38. Only 0, 3, and 5 may be selected for a front part of the forty samples, only 34, 36, and 38 may be selected for a back part, and every sample may be checked to determine whether the attack exists from a middle part having a strong probability that the attack exists. As such, the forty samples can represent the position of the attack with only five bits.

If the position of the attack is a pulse position index 22 from among the forty samples, the first and second tracks may be adaptively selected as described below.

The pulse position indices of the first track are 22, 23, 24, and 25, and the pulse position indices of the second track are 26, 27, 28, 29, 30, 31, 32, 33, 34, 35, 36, 37, 38, 39, 21, and 22. Since four pulses exist in the first track, a pulse may be found from each of the pulse position indices 22, 23, 24, and 25. One pulse exists in the second track and the encoding efficiency may be improved by detecting the pulse from a close position from the position of the attack.

As such, twelve bits are allocated to represent the position indices (5+1+1+1+4=12), and five bits are allocated to represent a sign of each pulse (1+1+1+1+1=5). When compared to the pulse track structure illustrated in FIG. 10A, the same number of bits are allocated. However, by concentrating on sample positions close to the position of the attack to detect a pulse, the encoding efficiency may be improved.

Figure 11:
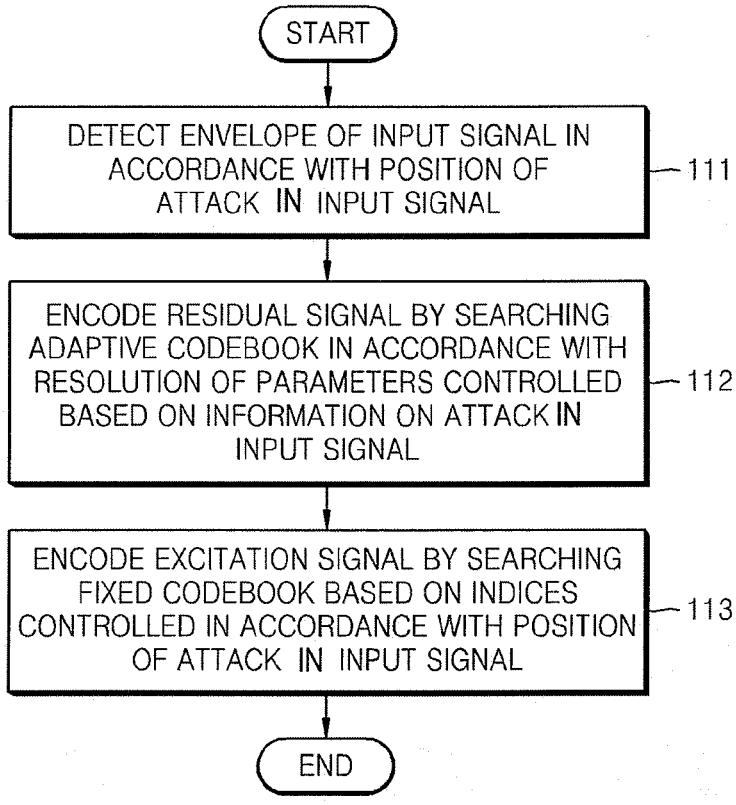
FIG. 11 is a flowchart of a method of encoding an audio/speech signal in the time domain, according to an embodiment of the present invention.

FIG. 11 is a flowchart of a method of encoding an audio/speech signal in the time domain, according to an embodiment of the present invention.

Referring to FIG. 11, in operation 111, an envelope of an input signal is detected in accordance with a position of an attack in the input signal. Specifically, the envelope of the input signal is detected by applying a window which has a shape and/or length that is adjustable in accordance with the position of the attack in the input signal.

In operation 112, a residual signal except for the envelope of the input signal is encoded by searching an adaptive codebook for modeling the residual signal in accordance with resolution of parameters controlled through information in an attack on the input signal.

In operation 113, an un-encoded excitation signal is encoded by searching a fixed codebook for modeling the excitation signal by searching the adaptive codebook based on indices controlled in accordance with the position of the attack on the input signal.

Figure 12:
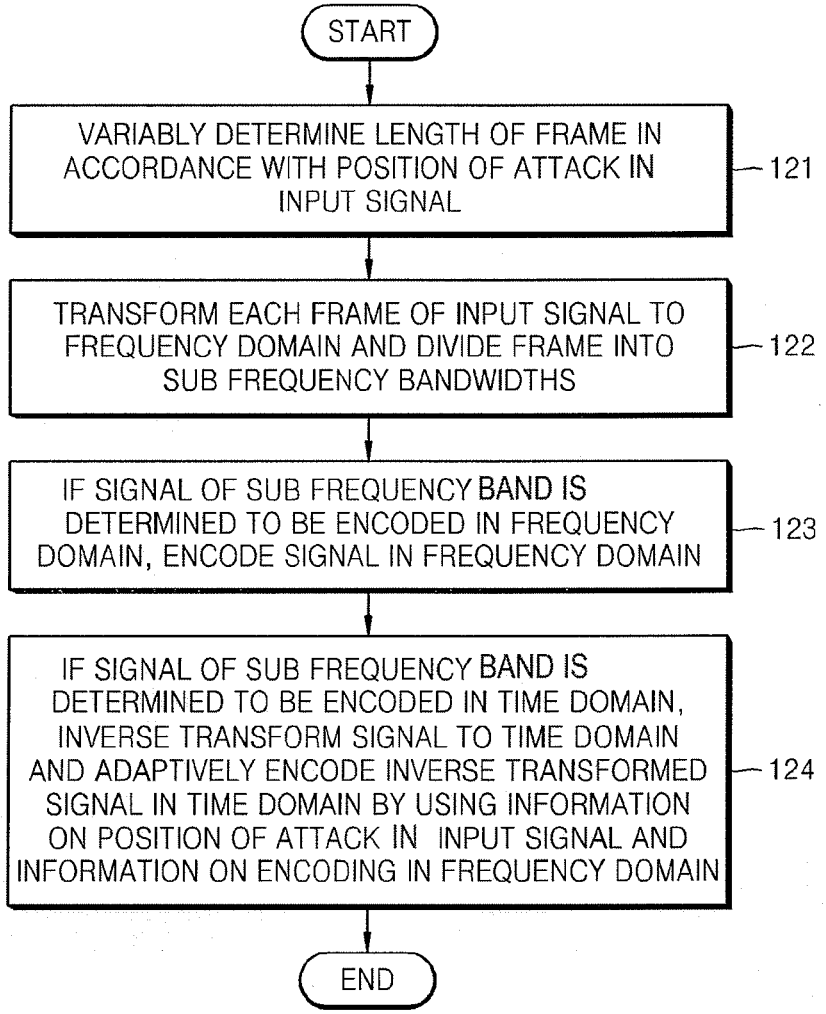
FIG. 12 is a flowchart of a method of encoding an audio/speech signal, according to another embodiment of the present invention.

FIG. 12 is a flowchart of a method of encoding an audio/speech signal, according to another embodiment of the present invention.

Referring to FIG. 12, in operation 121, a length of a frame, that is a processing unit of an input signal, is determined in accordance with a position of an attack on the input signal.

In operation 122, each frame of the input signal is transformed to the frequency domain and the transformed frame is divided into a plurality of sub frequency bands.

In operation 123, if a signal of a sub frequency band is determined to be encoded in the frequency domain, the signal of the sub frequency band is encoded in the frequency domain.

In operation 124, if a signal of a sub frequency band is determined to be encoded in the time domain, the signal of the sub frequency band is inverse transformed to the time domain and the inverse transformed signal is adaptively encoded in the time domain by using information on the attack in the input signal and information on the encoding of the frequency domain. Specifically, an envelope of the input signal is detected by applying a window to the input signal of which shape and/or length is adjustable in accordance with the position of the attack in the input signal, a residual signal except for an envelope of the input signal is encoded by searching an adaptive codebook for modeling the residual signal in accordance with resolution of parameters controlled via information on an attack in the input signal, and an un-encoded excitation signal is encoded by searching a fixed codebook for modeling the excitation signal by searching the adaptive codebook based on indices controlled in accordance with the position of the attack in the input signal.

The invention can also be embodied as computer readable codes on a computer readable recording medium.

The computer readable recording medium is any data storage device that can store data, which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion.

As described above, according to a method and apparatus for encoding an audio/speech signal according to the present invention, by performing encoding in accordance with encoding domains determined by frequency bands and frames having different lengths, which are adjusted in accordance with a position of an attack in an input signal, time resolution and frequency resolution may be controlled and thus encoding efficiency and sound quality may be improved.

According to a method and apparatus for decoding an audio/speech signal according to the present invention, by adaptively performing decoding in accordance with decoding domains determined by frequency bands and frames having different lengths, time resolution and frequency resolution may be controlled and thus encoding efficiency and sound quality may be improved.

According to a method of encoding an audio/speech signal in the time domain according to the present invention, by detecting an envelope when performing linear prediction analysis in accordance with a position of an attack on an input signal and adaptively applying an adaptive codebook and a fixed codebook in accordance with the position and intensity of the attack in the input signal, characteristics of the input signal may be reflected when the audio/speech signal is encoded and thus encoding efficiency and sound quality may be improved.

According to a method and apparatus for encoding an audio/speech signal according to the present invention, by variably determining lengths of frames in accordance with a position of an attack in an input signal, in time domain encoding, detecting an envelope when performing linear prediction analysis in accordance with a position of an attack in an input signal and adaptively applying an adaptive codebook and a fixed codebook in accordance with the position and intensity of the attack in the input signal, characteristics of the input signal may be reflected when the audio/speech signal is encoded and thus encoding efficiency and sound quality may be improved.

While the present invention has been particularly shown and described with reference to exemplary embodiments thereof, it will be understood by those of ordinary skill in the art that various changes in form and details may be made therein without departing from the spirit and scope of the invention as defined by the appended claims. The exemplary embodiments should be considered in a descriptive sense only and not for purposes of limitation. Therefore, the scope of the invention is defined not by the detailed description of the invention but by the appended claims, and all differences within the scope will be construed as being included in the present invention.

What is claimed is:

1. An apparatus for decoding an audio or speech signal, the apparatus comprising:

a determination unit to determine an encoding domain of a signal including a current frame, from mode information included in a bitstream;

a decoding unit to decode the signal of the current frame in the determined encoding domain, the determined encoding domain being either a frequency domain or a time domain; and a processing unit to transform the signal of the current frame decoded in the frequency domain into a time domain signal, wherein the signal of the current frame is decoded in the time domain, by using a fixed codebook and an adaptive codebook based on a long-term predictor.

2. The apparatus of claim 1, wherein the signal of the current frame is decoded in the frequency domain, by using at least one of a plurality of window sizes and a plurality of transform lengths, such that either time resolution or frequency resolution can be changed depending on characteristics of the signal.

3. An apparatus for decoding an audio or speech signal, the apparatus comprising:

at least one processor configured:

to determine an encoding domain of a signal including a current frame, from mode information included in a bitstream;

to decode the signal of the current frame in the determined encoding domain, the determined encoding domain being either a frequency domain or a time domain; and to transform the signal of the current frame decoded in the frequency domain into a time domain signal, wherein the signal of the current frame is decoded in the time domain, by using a fixed codebook and an adaptive codebook based on a long-term predictor.

4. The apparatus of claim 3, wherein the signal of the current frame is decoded in the frequency domain, by using at least one of a plurality of window sizes and a plurality of transform lengths, such that either time resolution or frequency resolution can be changed depending on characteristics of the signal.

* * * * *